US010907293B2

(12) United States Patent
Fugal et al.

(10) Patent No.: US 10,907,293 B2
(45) Date of Patent: Feb. 2, 2021

(54) STRUCTURAL BLOCK FOR SUPPORTING A ROTATING DRUM WITHIN A LAUNDRY APPLIANCE

(71) Applicant: WHIRLPOOL CORPORATION, Benton Harbor, MI (US)

(72) Inventors: Nicholas C. Fugal, Benton Harbor, MI (US); Bradley D. Morrow, Stevensville, MI (US); Joseph C. O'Connor, Benton Harbor, MI (US); Prabhath KV, Nellore (IN); Jason S. Sabel, Berrien Springs, MI (US); Christine L. Strain, Stevensville, MI (US); Meredith A. Wagner, St. Joseph, MI (US); Robert C. Williams, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 271 days.

(21) Appl. No.: 15/827,700

(22) Filed: Nov. 30, 2017

(65) Prior Publication Data

US 2019/0161899 A1 May 30, 2019

(51) Int. Cl.

| | |
|---|---|
| ***D06F 37/40*** | (2006.01) |
| ***D06F 23/04*** | (2006.01) |
| ***D06F 37/26*** | (2006.01) |
| *D06F 37/12* | (2006.01) |

(52) U.S. Cl.

CPC ..... *D06F 37/40* (2013.01); *D06F 23/04* (2013.01); *D06F 37/264* (2013.01); *D06F 37/12* (2013.01); *D06F 37/262* (2013.01)

(58) Field of Classification Search

CPC ..... D06F 23/04; D06F 37/40; D06F 37/262; D06F 37/264

See application file for complete search history.

(56) References Cited

U.S. PATENT DOCUMENTS

| | | | | |
|---|---|---|---|---|
| 5,297,403 A | | 3/1994 | Farrington et al. | |
| 5,373,715 A | * | 12/1994 | Sharp | D06F 37/12 68/133 |
| 8,650,918 B2 | | 2/2014 | McMaster et al. | |
| 9,291,201 B2 | | 3/2016 | Mola et al. | |
| 9,394,642 B2 | | 7/2016 | McMaster et al. | |

(Continued)

FOREIGN PATENT DOCUMENTS

| | | | |
|---|---|---|---|
| CN | 204199044 U | * | 3/2015 |
| CN | 103088598 B | * | 5/2015 |
| WO | 2013094112 | | 6/2013 |

OTHER PUBLICATIONS

Machine translation of CN-103088598-8, dated May 2015, (Year: 2015).*

*Primary Examiner* — Joseph L. Perrin
*Assistant Examiner* — Kevin G Lee
(74) *Attorney, Agent, or Firm* — Price Heneveld LLP

(57) ABSTRACT

A laundry appliance includes a rotating drum that receives laundry to be treated. A motor rotates a drive shaft about a vertical axis and engages the rotating drum at a base. A coupler is disposed within an upper portion of the base and that rests upon the drive shaft to transfer rotational forces from the drive shaft to the drum. A lower portion of the base engages an outer surface of the shaft to resist moment forces that are exerted against the drive shaft in an off-axis direction relative to the vertical axis.

19 Claims, 9 Drawing Sheets

(56) References Cited

U.S. PATENT DOCUMENTS

| | | | | |
|---|---|---|---|---|
| 2009/0145173 | A1* | 6/2009 | Seagar | D06F 37/40 68/12.16 |
| 2014/0283563 | A1 | 9/2014 | Hong et al. | |
| 2015/0000352 | A1 | 1/2015 | Carr et al. | |
| 2016/0194801 | A1 | 7/2016 | Kim et al. | |
| 2018/0156335 | A1* | 6/2018 | Lv | D06F 37/30 |

* cited by examiner

STRUCTURAL BLOCK FOR SUPPORTING A ROTATING DRUM WITHIN A LAUNDRY APPLIANCE

FIELD OF THE DEVICE

The device is in the field of laundry appliances, and more specifically, a structural block for attaching a rotating drum to a drive shaft for a vertical axis laundry appliance.

SUMMARY

In at least one aspect, a laundry appliance includes a rotating drum that receives laundry to be treated. A motor rotates a drive shaft about a vertical axis and engages the rotating drum at a base. A coupler is disposed within an upper portion of the base and that rests upon the drive shaft to transfer rotational forces from the drive shaft to the drum. A lower portion of the base engages an outer surface of the shaft to resist moment forces that are exerted against the drive shaft in an off-axis direction relative to the vertical axis.

In at least another aspect, a rotating drum for a laundry appliance includes a base having an upper portion that is connected to a lower portion. A drive shaft of a motor is coupled to the base and rotates the base about a vertical central axis. A structural block has a coupler disposed within the upper portion and a lower plate disposed within the lower portion. The coupler engages the drive shaft to transfer vertical and rotational forces between the base and the drive shaft. The lower plate engages an outer surface of the drive shaft below the coupler to absorb off-axis moment forces exerted by the base and direct the off-axis moment forces away from the coupler.

In at least another aspect, a laundry appliance includes a rotating drum that receives laundry to be treated. A motor rotates a drive shaft about a vertical axis. A structural block has an upper coupler and a lower plate and that connects the rotating drum to the drive shaft at the vertical axis. The upper coupler engages a top portion of the drive shaft to transfer forces that are exerted along and about the vertical axis between the rotating drum and the drive shaft. The lower plate engages an outer surface of the drive shaft below the top portion to absorb moment forces exerted by the rotating drum about a non-vertical axis and to direct the moment forces away from the top portion of the drive shaft and the coupler.

These and other features, advantages, and objects of the present device will be further understood and appreciated by those skilled in the art upon studying the following specification, claims, and appended drawings.

DETAILED DESCRIPTION OF EMBODIMENTS

Figure 1:
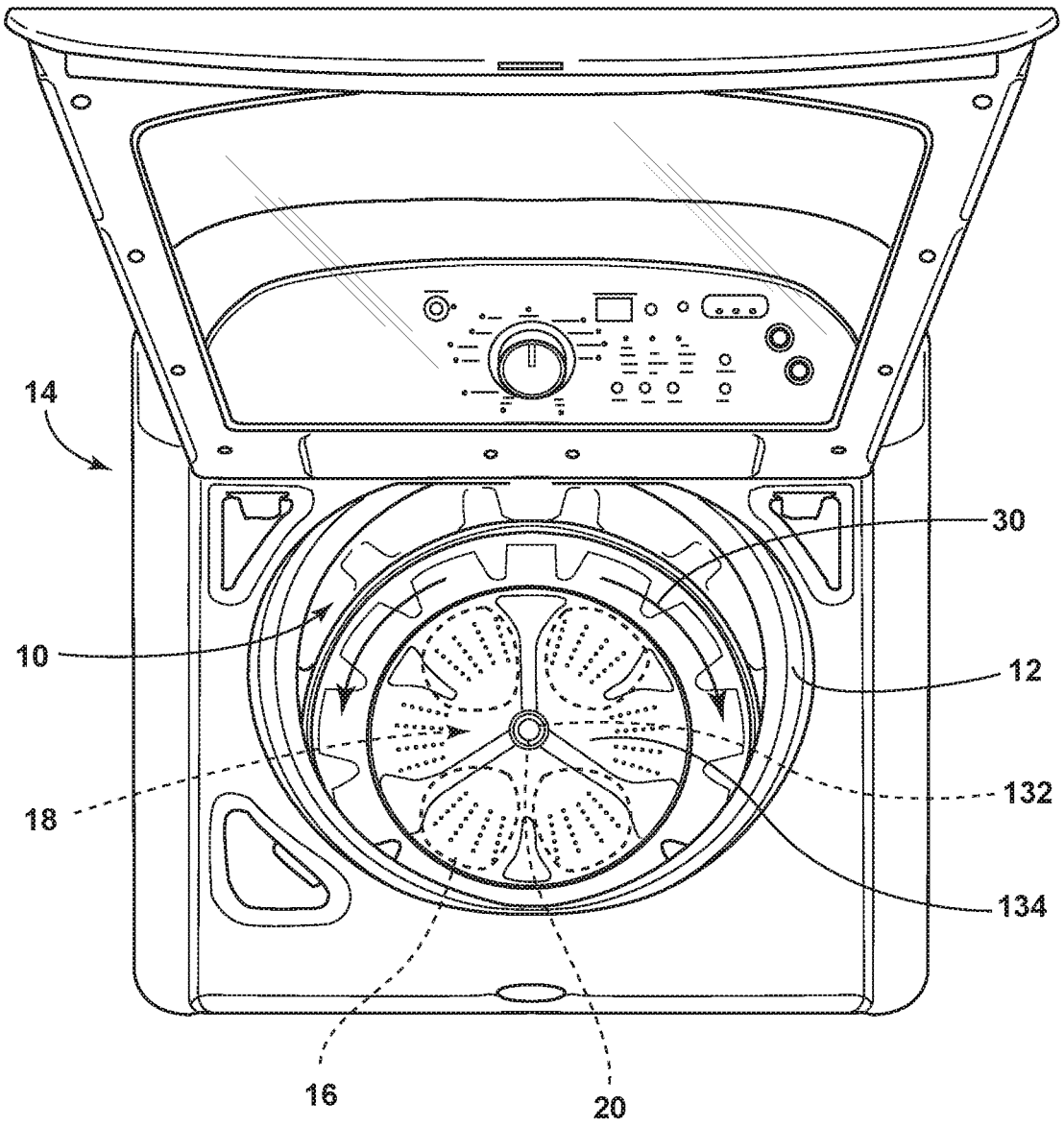
FIG. 1 is a top perspective view of a vertical axis laundry appliance having a rotating drum that is attached using an aspect of the structural block.
Figure 2:
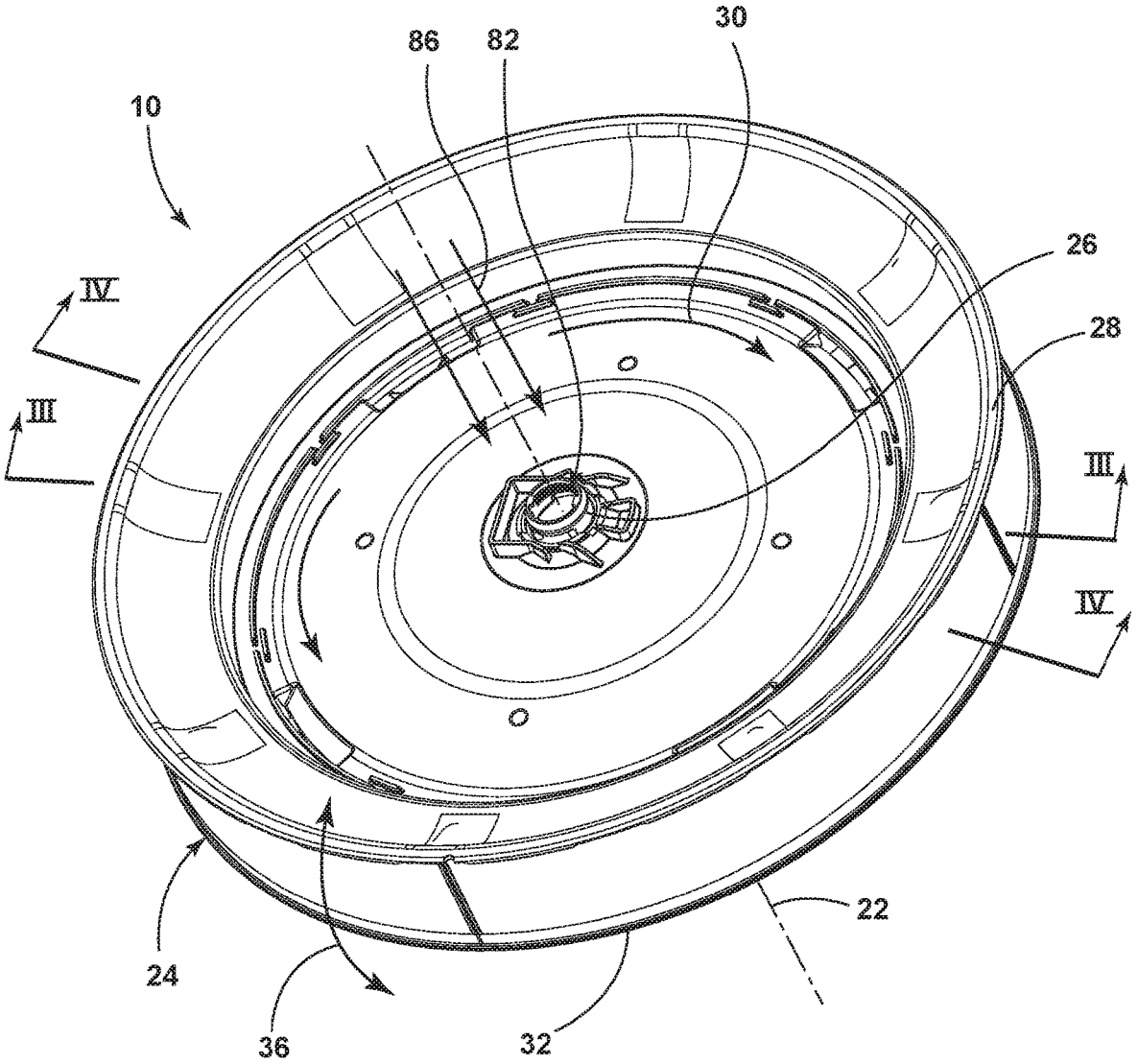
FIG. 2 is a top perspective view of a base for a rotating drum incorporating an aspect of the structural block.
Figure 3:
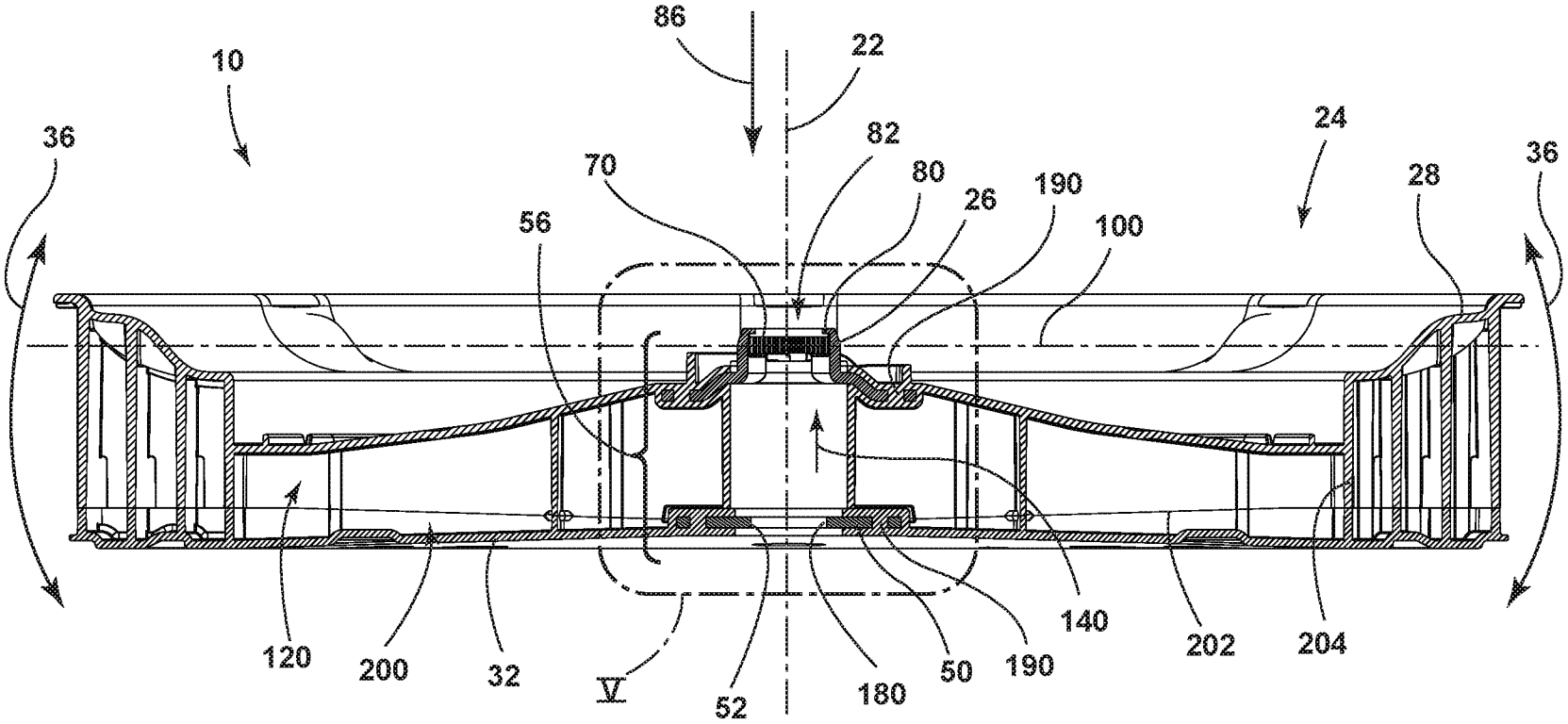
FIG. 3 is a cross-sectional view of the base of FIG. 2 taken along line III-III illustrating various open cavities of the base for the rotating drum.
Figure 4:
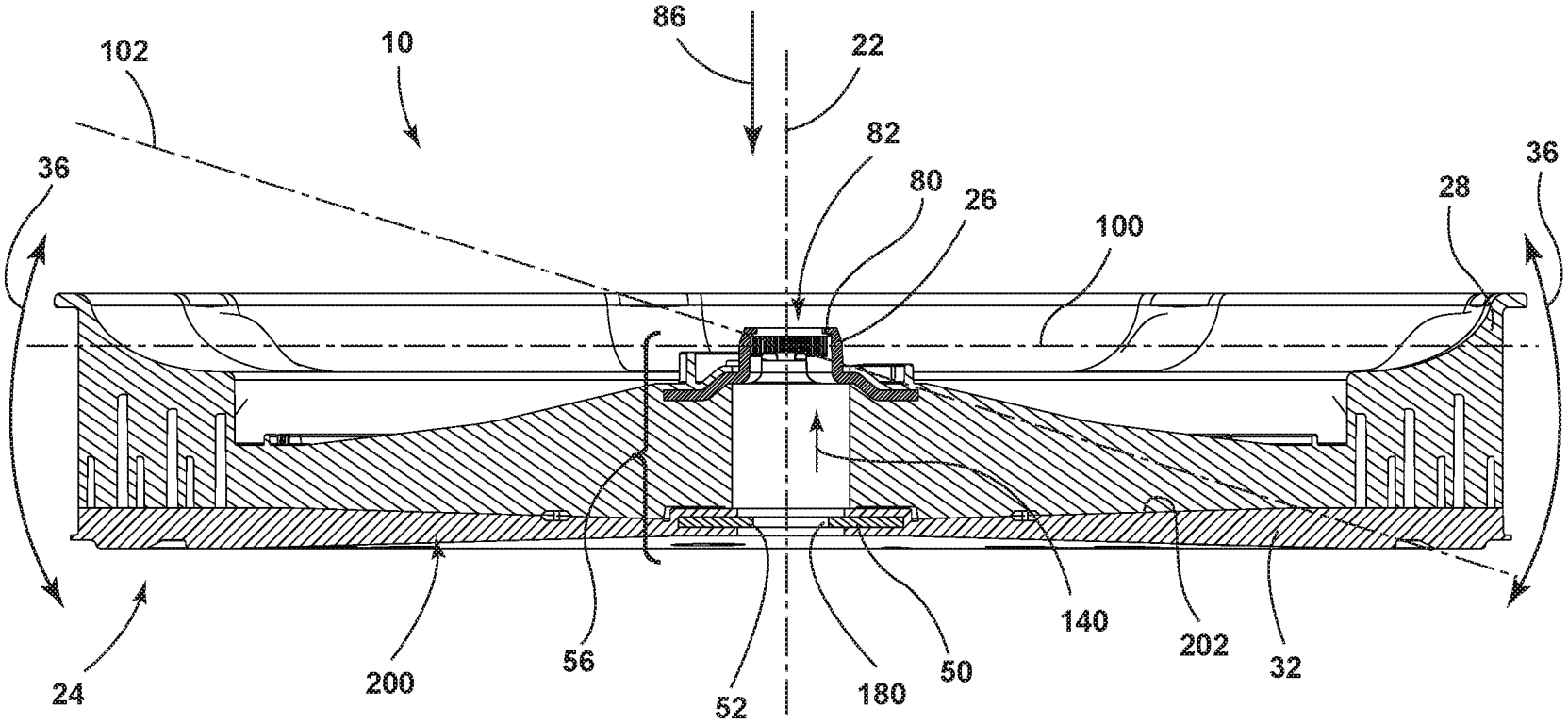
FIG. 4 is a cross-sectional view of the base of FIG. 2 taken along line IV-IV, and taken through lateral walls within an interior of the base.
Figure 5:
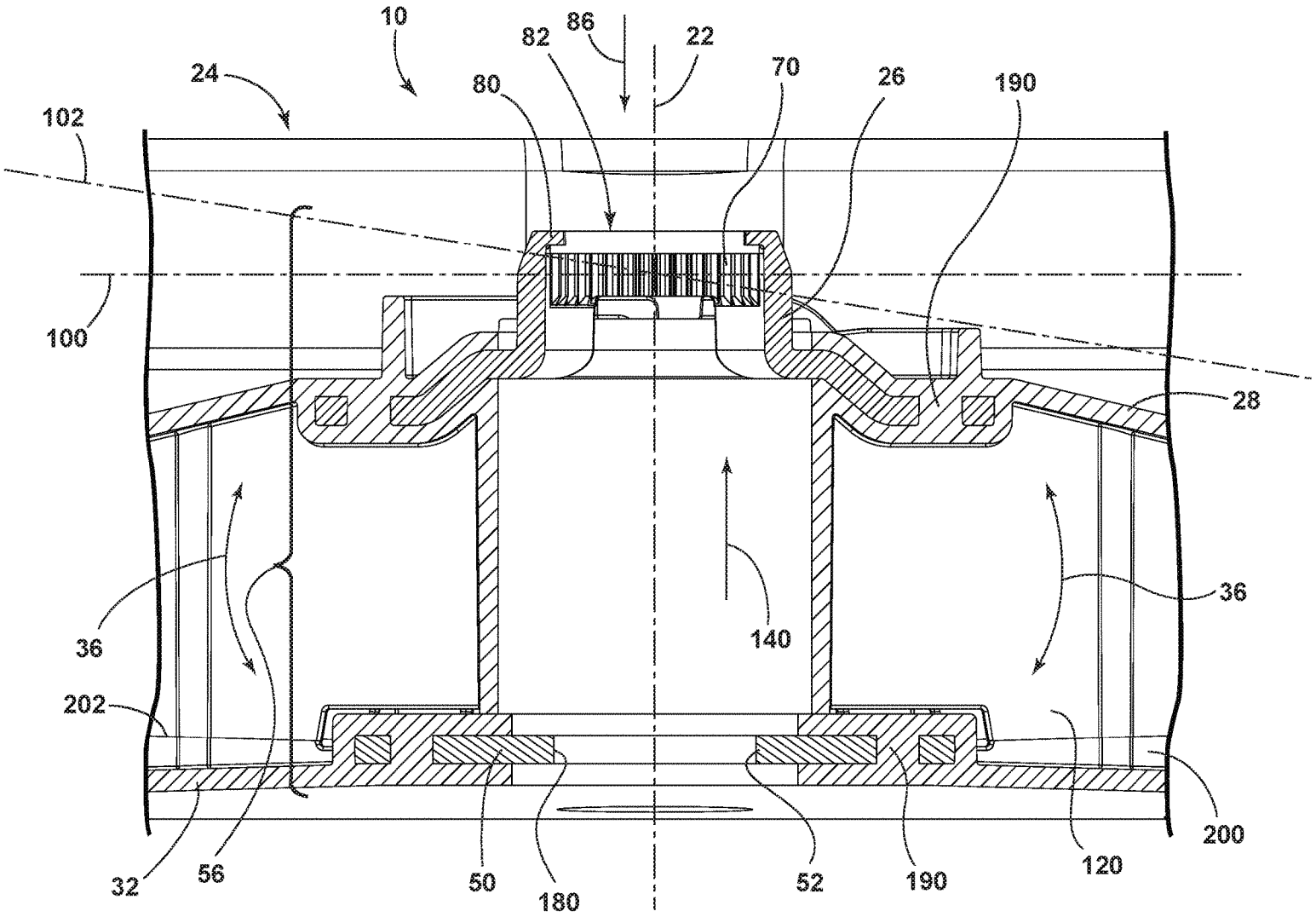
FIG. 5 is an enlarged cross-sectional view of the base of FIG. 3 taken at area V.
Figure 6:
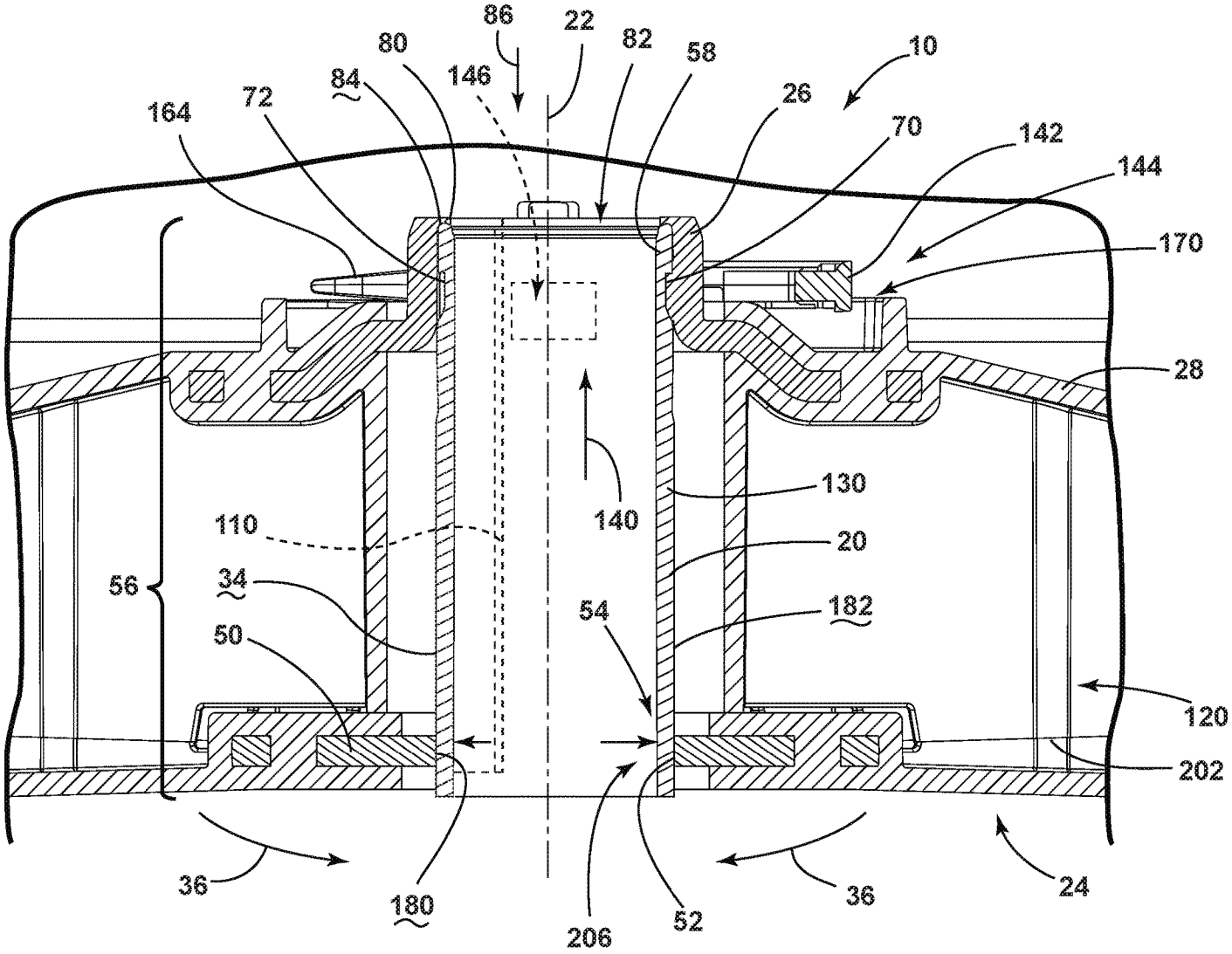
FIG. 6 is a cross-sectional view of the structural block of FIG. 5 showing the structural block placed upon the drive shaft.
Figure 7:
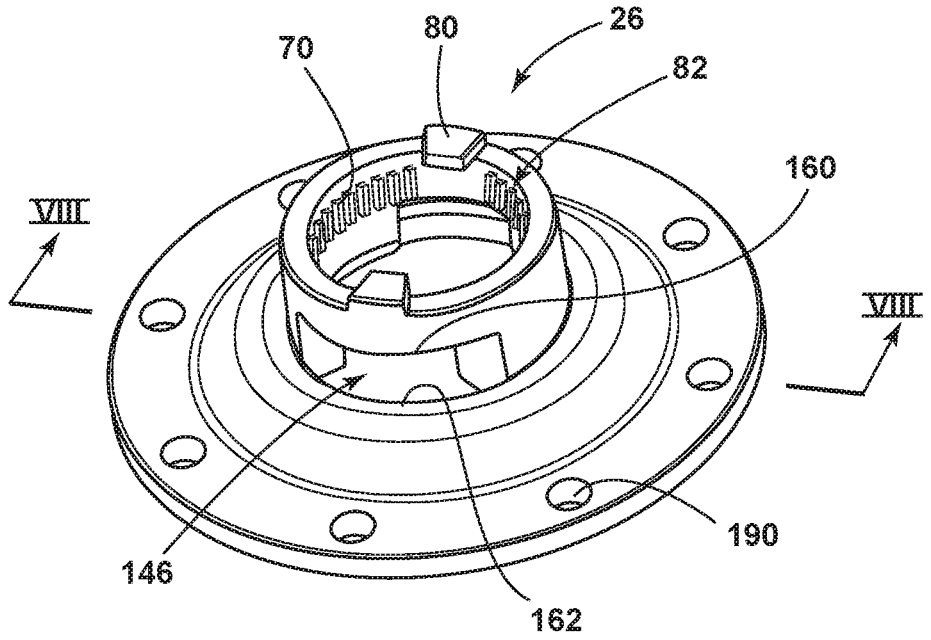
FIG. 7 is a top perspective view of a coupler used as part of the structural block for the base of the laundry appliance.
Figure 8:
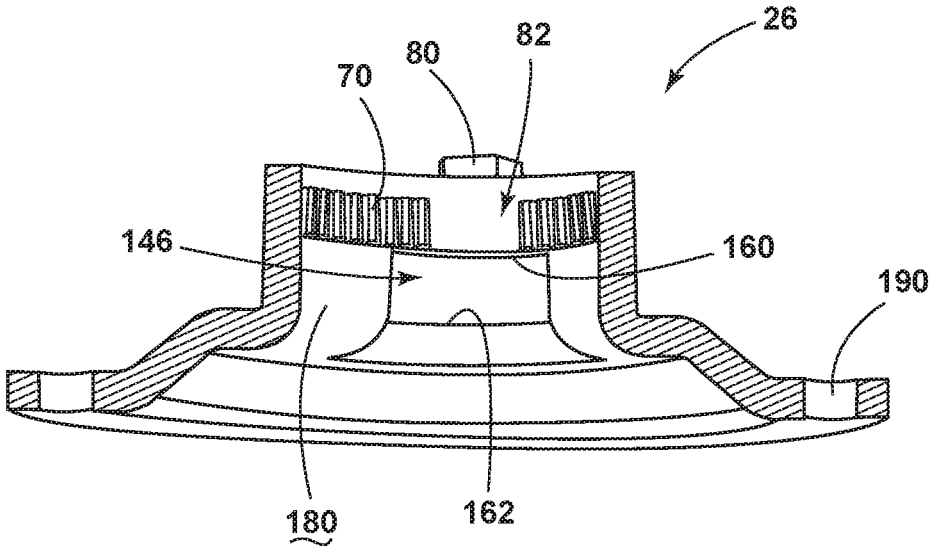
FIG. 8 is a cross-sectional view of the coupler of FIG. 8 taken along line VIII-VIII.
Figure 9:
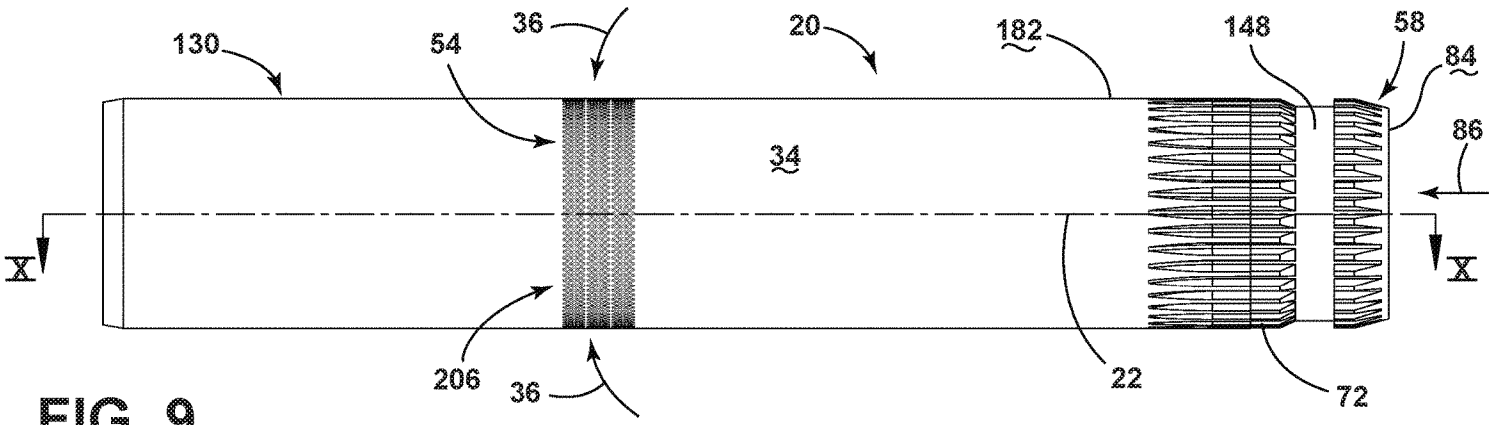
FIG. 9 is an elevational view of a drive shaft used to cooperate with the structural block.
Figure 10:
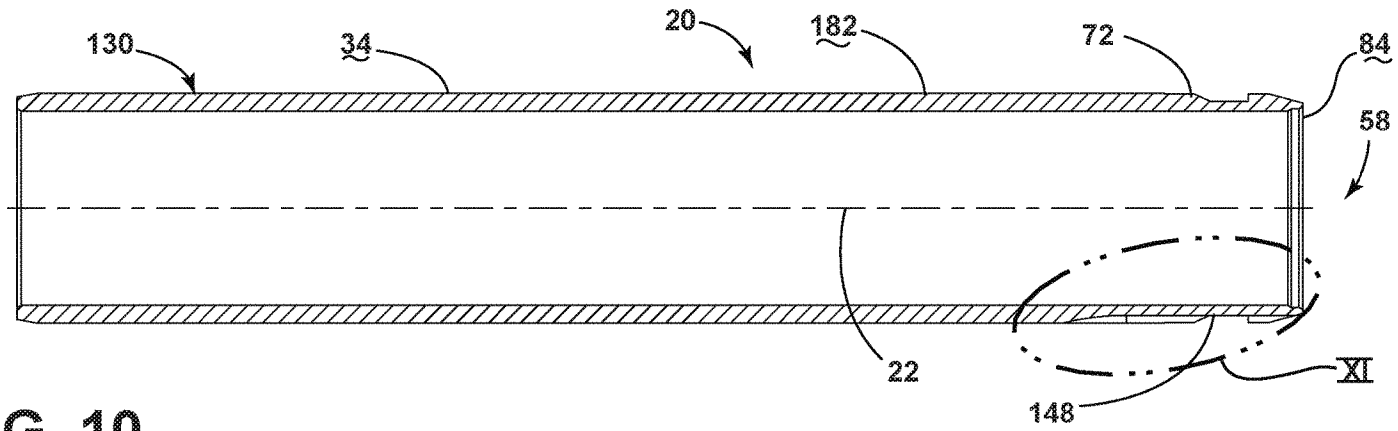
FIG. 10 is a cross-sectional view of the drive shaft of FIG. 9 taken along line X-X.
Figure 11:
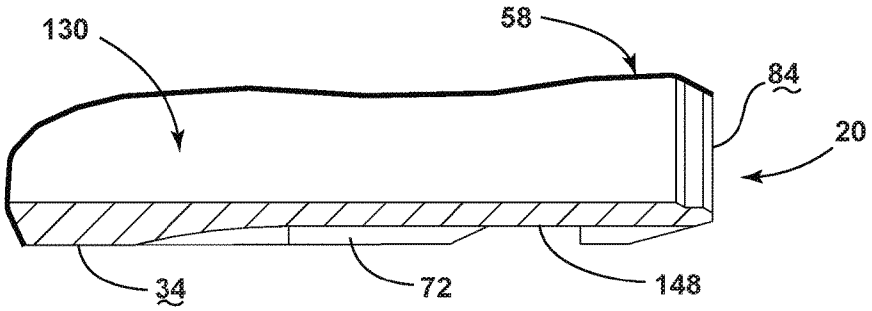
FIG. 11 is an enlarged cross-sectional view of the drive shaft of FIG. 10 taken at area XI.
Figure 12:
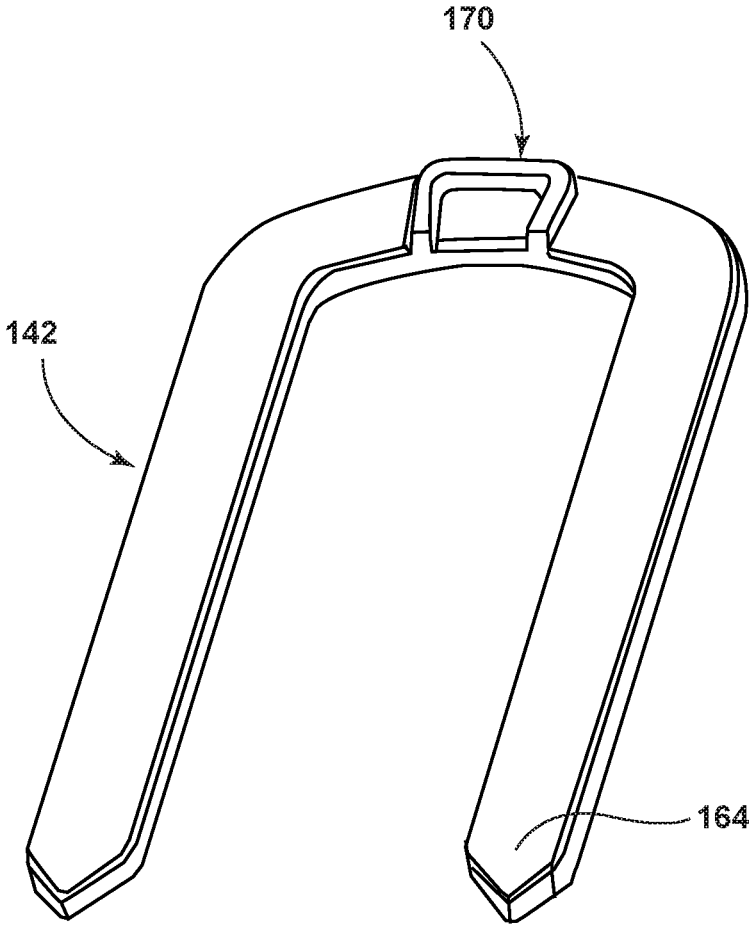
FIG. 12 is a top perspective view of a retaining clip for use in connection with the structural block for resisting upward lifting forces that may be exerted by the drum during operation.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As exemplified in FIGS. 1-11, reference numeral 10 generally refers to a rotating drum that is rotationally disposed within a tub 12 for a laundry appliance 14. The drum 10 is typically a perforated member that receives laundry 16 to be processed. The perforated drum 10 allows for fluid and detergent to be filled within the tub 12 so that the fluid and detergent within the tub 12 can pass through the perforated wall of the drum 10 and mix with the laundry 16 being treated within the rotating drum 10. The rotating drum 10 is configured to be rotated at varying directions, patterns and speeds that can include low speed spinning, high-speed spinning, agitation, combinations thereof, and other similar operating modes.

Referring again to FIGS. 1-11, the laundry appliance 14 includes the rotating drum 10 that receives the laundry 16 to be treated. A motor 18 disposed within the appliance 14 rotates a drive shaft 20 about a vertical axis 22. This drive shaft 20 engages the rotating drum 10 at a base 24. A coupler 26 is disposed within an upper portion 28 of the base 24. The coupler 26 is configured to rest upon the drive shaft 20 to transfer rotational forces 30 from the drive shaft 20 to the drum 10. The coupler 26 also allows for transfer of rotational forces 30 from the drum 10 to be received by the drive shaft 20 so that the drive shaft 20 can cause the rotating drum 10 to accelerate and decelerate about the vertical axis 22. A lower portion 32 of the base 24 engages an outer surface 34 of the shaft to resist off-axis moment forces 36 that are exerted against the drive shaft 20 in a direction generally perpendicular to the vertical axis 22 (illustrated generally at FIG. 6). As will be described more fully below, the off-axis moment forces 36 are typically in the form of off-axis wobbling of the rotating drum 10. Such off-axis wobbling can be experienced during rotation of the rotating drum 10 about the vertical axis 22.

The lower portion 32 of the base 24 for the rotating drum 10 includes a lower plate 50. This lower plate 50 within the lower portion 32 of the base 24 includes a central bore 52 that engages an intermediate portion 54 of the drive shaft 20. The coupler 26 and the lower plate 50 cooperate to form a structural block 56 within the base 24. The structural block 56 is configured to distribute the off-axis moment forces 36 experienced by the rotating drum 10. These off-axis moment forces 36 are distributed to an area, typically the intermediate portion 54, that is distal from and below a top portion 58 of the drive shaft 20 where the coupler 26 engages the drive shaft 20.

Referring now to FIGS. 5-11, the structural block 56 is disposed within the base 24 of the rotating drum 10 so that various forces that are exerted between the base 24 and the drive shaft 20 can be counteracted and/or absorbed to limit wear and tear that may result from these forces exerted during operation of the appliance 14. The coupler 26 of the structural block 56 is configured to rest on a top portion 58 of the drive shaft 20. The coupler 26 can include a plurality of inner splines 70 that matingly receive a plurality of outer splines 72 in the drive shaft 20. The intermingling of the inner and outer splines 70, 72 of the coupler 26 and the drive shaft 20, respectively, allow for rotational forces 30 to be transmitted from the drive shaft 20 to the drum 10, via the coupler 26, during phases of a particular laundry-processing cycle that require acceleration of the drum 10 within the tub 12. Similarly, the engagement of the inner and outer splines 70, 72 allow for rotational forces 30 to be exerted from the drum 10 and into the drive shaft 20, again via the coupler 26, during phases of a particular washing operation that require deceleration of the rotating drum 10.

The coupler 26 can also include one or more and potentially a plurality of upper flanges 80 that extend inward into a central opening 82 of the coupler 26 and typically above the plurality of inner splines 70. The plurality of upper flanges 80 of the coupler 26 are configured to extend into the central opening 82 and rest on a top surface 84 of the drive shaft 20. Accordingly, the upper flanges 80 of the drive shaft 20 serve to transfer vertical loads 86 exerted by the drum 10 into the drive shaft 20. These vertical loads 86 can include the weight of the drum 10, the weight of a load of laundry 16, the weight of the fluid and detergent, and other loads that might be carried by the rotating drum 10.

The rotational forces 30 that are transferred between the inner and outer splines 70, 72 and the vertical loads 86 that are transferred via the plurality of upper flanges 80 typically occur with respect to the vertical axis 22. In this manner, the rotational forces 30 that are transferred between the inner and outer splines 70, 72 occur about the vertical axis 22. The vertical loads 86 exerted by the drum 10 and that are transferred to the drive shaft 20 via the upper flanges 80 of the coupler 26 are typically in alignment with the vertical axis 22. Accordingly, the engagement between the coupler 26 of the structural block 56 and the top portion 58 of the drive shaft 20 can serve to adequately transfer these rotational forces 30 and vertical loads 86, with respect to the vertical axis 22, between the base 24 of the drum 10 and the drive shaft 20.

As exemplified in FIGS. 1-6, as the drum 10 operates to process laundry 16, forces that are exerted by the load of laundry 16 and fluid disposed within the drum 10 may be exerted in an unbalanced manner. These unbalanced forces can typically be in the form of laundry 16 that is unbalanced within the drum 10. These unbalanced load conditions can result in the off-axis moment forces 36 that are typically in the form of a wobble of the drum 10. When the base 24 of the drum 10 is at rest and not rotating about the vertical axis 22, the drum 10 is typically positioned within a generally horizontal plane 100. As the drum 10 rotates, the unbalanced load disposed within the drum 10 can cause the base 24 of the drum 10 to tend to rotate away from this horizontal plane 100. Movement of the drum 10 toward or within a non-horizontal plane 102 (shown exaggerated in FIGS. 4 & 5) results in the off-axis moment forces 36, or wobble, of the drum 10 within the tub 12.

In order to counteract this wobble, the lower plate 50 of the structural block 56 includes the central bore 52 that engages an intermediate portion 54 of the drive shaft 20. This engagement between the central bore 52 and the intermediate portion 54 of the drive shaft 20 is typically in a surface-to-surface engagement that is free of any interference-type engagement or other similar connecting methods or mechanisms. In this manner, the lower plate 50, through its surface engagement with the intermediate portion 54 of the drive shaft 20, is configured to only receive and counteract these off-axis moment forces 36.

Because the lower plate 50 is spaced apart from the coupler 26 and the top portion 58 of the drive shaft 20, the structural block 56 forms a type of lever or moment arm 110 that can counteract the wobble of the base 24. Typically, the wobble of the base 24 occurs at the top portion 58 of the drive shaft 20 where the coupler 26 rests on the top surface 84 of the drive shaft 20. Because the lower plate 50 is spaced apart and below the coupler 26, the coupler 26 acts as a fulcrum and the central bore 52 of the lower plate 50 serves as the end of the moment arm 110 formed by the structural block 56 to counteract the off-axis moment forces 36. In other words, the off-axis moment force 36 is distributed by the structural block 56 from the top portion 58 of the drive shaft 20, to the intermediate portion 54 of the drive shaft 20. By distributing this off-axis moment force 36, the load is better received by the drive shaft 20 to mitigate operational fatigue over the life-span of the appliance 14.

Referring again to FIGS. 3-11, the coupler 26 and the lower plate 50 can be made of various rigid materials that can include, but are not limited to, metal, plastic, composite materials, various polymers, combinations thereof, and other similar materials. Typically, the coupler 26 can be made of a metal casting and the lower plate 50 can be a metal stamping. These metal components can be insert injection-molded so that the coupler 26 is insert injection-molded within the upper portion 28 of the base 24 and the lower plate 50 is insert injection-molded within the lower portion 32 of the base 24. The upper and lower portions 28, 32 of the base 24 are typically welded together to form a unitary assembly of the base 24 that includes the coupler 26 and the lower plate 50 molded therein to form the structural block 56 as a unitary structural system of the rotating drum 10. Additionally, by welding together the upper and lower portions 28, 32 of the base 24, various interior cavities 120 can be formed within the base 24. These interior cavities 120 can be used for various purposes that can include, but are not limited to, structural reinforcement, holding sensors and/or mechanical features of the appliance 14, lowering the density and overall weight of the base 24, and other similar design considerations.

Referring again to FIGS. 1-11, the use of the structural block 56 formed by the coupler 26 and the lower plate 50 formed within the base 24 can be used to counteract various off-axis moment forces 36 or wobble that is experienced by the rotating basket. These off-axis moment forces 36 are typically experienced as the drum 10 rotates at high rates of speed and particularly when large loads of laundry 16 are disposed therein. The attachment between the structural block 56 and the drive shaft 20 provides structural support to handle these off-axis moment forces 36 and over extended periods of time of operation for the appliance 14.

As exemplified in FIGS. 1 and 9-11, the drive shaft 20 can be in the form of a spin tube 130 that is engaged with the rotating drum 10. The spin tube 130 can be a rotating member that rotates about a central shaft 132 that can be engaged to an agitator, spider, or other centrally positioned agitating feature 134 within the drum 10. During operation of the appliance 14, the spin tube 130 can operate with the central shaft 132 and also operate independently or in cooperation with the central shaft 132. In other aspects of the device, the drive shaft 20 can be a single member that is attached to the motor 18 for operating the rotating drum 10 within the tub 12.

As exemplified in FIGS. 1 and 5-12, during operation of the rotating drum 10, the drum 10 can experience certain lifting forces 140 where rotation of the drum 10 causes the base 24 of the drum 10 to lift off from the drive shaft 20. These lifting forces 140 are experienced, typically, during high-speed rotation of the rotating drum 10. To counteract this lifting force 140, a retaining clip 142 can be included that engages the coupler 26 and a drive shaft 20 in a secured position 144. When the retaining clip 142 is in the secured position 144, the retaining clip 142 is configured to resist at least vertical lifting forces 140 that are exerted by the drum 10 during these high-speed rotation phases. The retaining clip 142 is configured to engage the outer surface 34 of the drive shaft 20 through a cooperative recess 146 that is defined within the coupler 26. The cooperative recess 146 exposes a smooth channel 148 disposed within the plurality of outer splines 72 defined within the outer surface 34 of the drive shaft 20.

When the retaining clip 142 is engaged with the coupler 26, upper and lower shoulders 160, 162 that define the cooperative recess 146 maintain the positioning of the retaining clip 142 with respect to the coupler 26. Tines 164 of the retaining clip 142 extend between the upper and lower shoulders 160, 162 and engage the cooperative recess 146 as well as the smooth channel 148 of the drive shaft 20. The smooth channel 148 is a recessed channel defined within the plurality of outer splines 72 of the drive shaft 20. In this manner, the engagement of the retaining clip 142 with the drive shaft 20 and the coupler 26 serves to counteract this lifting force 140 that can be exerted by the drum 10 during a high-speed rotation phase. The magnitude of this lifting force 140 is typically less than 10 pounds of force. Accordingly, the retaining clip 142 needs to provide only a minimal amount of securing force to counteract these lifting forces 140.

As exemplified in FIGS. 2 and 5-12, the retaining clip 142 can include various interference features 170 that are adapted to engage and connect with the coupler 26 and the drive shaft 20. These interference features 170 can generate a snapping or interference-type engagement that maintains engagement of the retaining clip 142 with the coupler 26 and the drive shaft 20.

Referring again to FIGS. 1-12, the rotating drum 10 for the laundry appliance 14 can include the base 24 that has an upper portion 28 that is connected to a lower portion 32. As discussed above, the upper portion 28 is typically welded to the lower portion 32 to form a unitary base 24 of the rotating drum 10. The drive shaft 20 of the motor 18 is coupled to the base 24, where the drive shaft 20 rotates the base 24 about the vertical axis 22. The structural block 56 of the base 24 includes the coupler 26 disposed within the upper portion 28 of the base 24. The lower plate 50 of the structural block 56 is disposed within the lower portion 32 of the base 24. The coupler 26 is configured to engage the drive shaft 20 at a plurality of outer splines 72 to transfer vertical and rotational forces 30 between the base 24 and the drive shaft 20. Additionally, the lower plate 50 engages the outer surface 34 of the drive shaft 20 and below the plurality of outer splines 72 to absorb off-axis moment forces 36 that are exerted by the base 24 and also to direct these off-axis moment forces 36 away from the plurality of outer splines 72 of the drive shaft 20.

In various aspects of the device, the central bore 52 of the lower plate 50 can include an inner circumference 180 that substantially matches an outer circumference 182 of the outer surface 34 of the drive shaft 20. The sizing of the inner circumference 180 of the central bore 52 and the outer circumference 182 of the drive shaft 20 serves to define a surface engagement. In various aspects of the device, the central bore 52 can be sized to have an inner circumference 180 that is slightly larger than the outer circumference 182 of the drive shaft 20. In such an engagement, a minimal amount of off-axis movement or wobble is permitted where the central bore 52 is larger than the outer surface 34 of the drive shaft 20. In such an embodiment, the central bore 52 is configured to rest around the outer circumference 182 of the drive shaft 20. Accordingly, when the drum 10 is at rest, the central bore 52 may be free of engagement with the outer surface 34 of the drive shaft 20. The minimal amount of wobble afforded by the rotating drum 10 with respect to the drive shaft 20 can serve to assist in the absorption of the off-axis moment forces 36 that are exerted by the drum 10 during high-speed rotation.

The laundry appliance 14 described herein can include the rotating drum 10 that receives laundry 16 to be treated. The motor 18 of the appliance 14 rotates the drive shaft 20 about the vertical axis 22, and the structural block 56 includes the upper coupler 26 and lower plate 50 that connect the rotating drum 10 to the drive shaft 20 at the vertical axis 22. The upper coupler 26 engages the drive shaft 20 at the plurality of outer splines 72 to transfer forces that are exerted along and about the vertical axis 22, between the rotating drum 10 and the drive shaft 20. Additionally, the lower plate 50 engages the outer surface 34 of the drive shaft 20 and below the plurality of outer splines 72 to absorb and/or counteract moment forces that are exerted by the rotating drum 10 about a non-vertical axis. This engagement between the lower plate 50 and the outer surface 34 of the drive shaft 20 also serves to direct the off-axis moment forces 36 away from the plurality of outer splines 72 of the drive shaft 20.

By directing these off-axis moment forces 36 away from the plurality of outer splines 72, the engagement between the coupler 26 and the drive shaft 20 may experience less stress and may extend the life of the base 24 of the drum 10 and the drive shaft 20. By transferring the off-axis moment forces 36 away from the outer splines 72, off-axis twisting and rotation between the inner and outer splines 70, 72 can be mitigated. In this manner, the operational life span of the inner and outer splines 70, 72 of the coupler 26 and the drive shaft 20, respectively, can also be extended. This can give the appliance 14 a longer overall life span and also extend the period of time between repair and/or replacement of the drum 10, the drive shaft 20, and other components of the drive system for the appliance 14.

As discussed previously, the coupler 26 and the lower plate 50 are typically insert injection molded within the upper and lower portions 28, 32 of the base 24, respectively. To assist in the injection molding of these components, the coupler 26 and the lower plate 50 can include securing apertures 190 that can receive portions of the plastic material that are injection molded to form the upper and lower portions 28, 32 of the base 24. In various aspects of the device, the material of the upper and lower portions 28, 32 of the base 24 can be the same material.

These components can also be made of different injectable materials that can be injected around the coupler 26 and the lower plate 50. The formations of the upper and lower portions 28, 32 of the base 24 are configured to assist in the counteracting of the various vertical, rotational, and off-axis moment forces 36 that are exerted by the drum 10 and the base 24 against the drive shaft 20. Formations of the lower portions 32 of the base 24 surrounding the lower plate 50 can assist in absorbing and counteracting the off-axis moment forces 36. Accordingly, the lower portion 32 of the base 24 can include a substantially planar member 200 that can be used to adequately absorb the off-axis moment forces 36. Similarly, the upper portion 28 of the base 24 can include the plurality of interior cavities 120 that can be used to distribute vertical and rotational forces 30 throughout the base 24 during operation of the appliance 14. The upper and lower portions 28, 32 are engaged to one another at a parting line 202 that extends generally horizontally through the base 24. Each of the upper and lower portions 28, 32 can include sections of the interior walls 204 that extend generally vertically through the base 24 and form the interior cavities 120. The formations of the upper and lower portions 28, 32 of the base 24 cooperate to absorb the various forces that are exerted by the base 24 onto the drive shaft 20.

Within the intermediate portion 54 of the drive shaft 20, the drive shaft 20 can include a reinforced portion 206 that engages the central bore 52 of the lower plate 50. This reinforced portion 206 can be included to better counteract the off-axis moment forces 36 that are transferred by the lower plate 50 of the structural block 56 and to the drive shaft 20.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A laundry appliance comprising:

a rotating drum that receives laundry to be treated;

a motor that rotates a drive shaft about a vertical axis and engages the rotating drum at a base;

a coupler disposed within an upper portion of the base and that rests upon the drive shaft in a rotationally fixed engagement to transfer rotational forces from the drive shaft to the rotating drum;

a lower portion of the base; and a lower plate that is spaced apart from the coupler and disposed within the lower portion of the base such to form a hollow space between the base and the drive shaft, wherein the lower plate includes a central bore having a smooth circular inner bore that engages a smooth outer surface of the drive shaft in surface-to-surface engagement to resist only moment forces that are exerted against the drive shaft in an off-axis direction relative to the vertical axis, and wherein the coupler provides rotational and axial support to the base relative to the drive shaft.

2. The laundry appliance of claim 1, wherein the central bore of the lower plate engages an intermediate portion of the drive shaft.

3. The laundry appliance of claim 1, wherein the moment forces include off-axis wobbling of the base experienced during rotation of the rotating drum about the vertical axis.

4. The laundry appliance of claim 1, wherein the coupler and the lower plate cooperate to form a structural block within the base, wherein the structural block distributes the moment forces to an area distal from the coupler and a top portion of the drive shaft.

5. The laundry appliance of claim 1, wherein the coupler is insert injection molded into the upper portion of the base.

6. The laundry appliance of claim 5, wherein the lower plate is insert injection molded in the lower portion of the base.

7. The laundry appliance of claim 1, wherein the upper portion of the base and the lower portion of the base are welded together to form a unitary assembly that includes the coupler and the lower plate molded therein.

8. The laundry appliance of claim 1, wherein the coupler includes a plurality of inner splines that matingly receive a plurality of outer splines of the drive shaft.

9. The laundry appliance of claim 1, wherein the coupler is made of a metal casting that includes a plurality of upper flanges that rest on a top surface of the drive shaft, and wherein the upper flanges of the coupler transfer a vertical load of the rotating drum to the drive shaft.

10. The laundry appliance of claim 1, further comprising:

a retaining clip that engages the coupler and the drive shaft in a secured position, wherein the secured position is configured to resist at least upward vertical forces exerted by the rotating drum during a high-speed rotation of the rotating drum.

11. The laundry appliance of claim 10, wherein the retaining clip engages the smooth outer surface of the drive shaft through a cooperative recess defined within the coupler, wherein the cooperative recess exposes a smooth channel disposed within a plurality of outer splines of the drive shaft.

12. A rotating drum for a laundry appliance, the rotating drum comprising:

a base having an upper portion that is connected to a lower portion, a drive shaft of a motor that is coupled to the base and that rotates the base about a vertical central axis;

a structural block having a coupler disposed within the upper portion and a lower plate disposed within the lower portion; wherein the coupler engages the drive shaft to transfer vertical and rotational forces between the base and the drive shaft; and the lower plate is a separate member that is spaced apart from the coupler and that engages an outer surface of the drive shaft below the coupler to absorb only off-axis moment forces exerted by the base and direct the off-axis moment forces away from the coupler wherein the base does not directly contact the drive shaft.

13. The rotating drum of claim 12, wherein the off-axis moment forces include off-axis wobbling of the base experienced during rotation of the rotating drum about the vertical central axis.

14. The rotating drum of claim 12, wherein the lower plate includes a central bore having an inner circumference that substantially matches an outer circumference of the outer surface of the drive shaft to define a surface engagement, wherein the lower plate is configured to only receive the off-axis moment forces exerted by the rotating drum.

15. The rotating drum of claim 12, wherein the coupler is insert injection molded into the upper portion of the base and the lower plate is insert injection molded in the lower portion of the base.

16. The rotating drum of claim 15, wherein the upper portion of the base and the lower portion of the base are welded together to form a unitary assembly that includes the coupler and the lower plate molded therein.

17. The rotating drum of claim 12, further comprising:

a retaining clip that engages the coupler and the drive shaft in a secured position, wherein the secured position is configured to resist at least upward vertical forces exerted by the rotating drum during a high-speed rotation of the rotating drum.

18. A laundry appliance comprising:

a rotating drum that receives laundry to be treated;

a motor that rotates a drive shaft about a vertical axis; and a structural block having an upper coupler and a lower plate and that connects the rotating drum to the drive shaft at the vertical axis; wherein the upper coupler engages a top portion of the drive shaft to transfer forces that are exerted along and about the vertical axis between the rotating drum and the drive shaft; and the lower plate the lower plate is a separate member spaced apart from the upper coupler such to form a hollow space between the structural block and the drive shaft and that engages an outer surface of the drive shaft below the top portion to absorb only moment forces exerted by the rotating drum about a non-vertical axis and to direct the moment forces away from the top portion of the drive shaft and the upper coupler.

19. The laundry appliance of claim 18, wherein the rotating drum includes a base, and wherein an upper portion of the base and a lower portion of the base are welded together to form a unitary assembly of the base that includes the upper coupler and the lower plate that are insert injection molded therein.

* * * * *